United States Patent [19]

Beihoffer et al.

[11] Patent Number: 4,766,623

[45] Date of Patent: Aug. 30, 1988

[54] SPRING COUNTERBALANCED FOLDING WALL BED

[76] Inventors: William L. Beihoffer, 1903 East/15th, Burnsville, Minn. 55337; Douglas C. Zellmer, 917 Westwood Ct., Farmington, Minn. 55024

[21] Appl. No.: 77,107

[22] Filed: Jul. 23, 1987

[51] Int. Cl.[4] ..... A47C 19/06

[52] U.S. Cl. ..... 05/164 R; 5/136

[58] Field of Search ..... 5/164 R, 164 B, 136, 5/166 R, 164 E; 248/292.1, 240.4, 280.1, 123.1

[56] References Cited

U.S. PATENT DOCUMENTS

| | | | |
|---|---|---|---|
| 1,918,085 | 7/1933 | Cocks | 5/164 R X |
| 3,909,857 | 10/1975 | Herrera | 5/164 R |
| 4,266,747 | 5/1981 | Souder | 248/123.1 X |
| 4,329,746 | 5/1982 | Bergerud | 4/164 R |
| 4,370,766 | 2/1983 | Teague | 5/164 R X |
| 4,589,152 | 5/1986 | Pakosh | 5/164 R |

FOREIGN PATENT DOCUMENTS

| | | | |
|---|---|---|---|
| 1322080 | 2/1963 | France | 5/164 E |

*Primary Examiner*—J. Franklin Foss

*Attorney, Agent, or Firm*—James V. Harmon

[57] ABSTRACT

A spring counter-balanced folding wall bed is described in which compression springs are mounted along the inside surfaces of the bed frame members. The bed frame members are pivoted on a supporting framework and a connecting rod extends between one end of the spring and a spring pivot which is mounted a distance D on the opposite side of the bed pivot from the bed and by a distance H above the bed pivot so that when the bed frame is raised the bed spring is extended and when the bed is lowered the spring is compressed to thereby counter-balance the weight of the bed.

6 Claims, 2 Drawing Sheets

SPRING COUNTERBALANCED FOLDING WALL BED

FIELD OF THE INVENTION

The invention relates to bedding and more particularly to spring counterbalanced folding beds.

BACKGROUND OF THE INVENTION

Folding beds have become increasingly popular in recent years because of the limited space available in new homes or homes remodeled to include additional sleeping space. However, prior folding beds have been either complicated in construction, subject to malfunction or have been difficult to raise and lower. It is therefore an object of the invention to create a balanced condition throughout movement from the vertical to a horizontal position by means of a mechanically simple and rugged mechanism with few moving parts which enables the bed to be easily raised or lowered with a minimum of effort. A further object is to provide a mechanism which will function efficiently with a variety of beds including twin, queen, king, extra long and double size with a further provision for adjusting the mechanism to operate efficiently with beds of each of these different sizes. More specifically, it is an object to provide an inexpensive spring counter-balanced folding wall bed mechanism which is integrated into a single unit and can be considered a module that is easy to install, has relatively few parts and is effective in reducing the force required in a typical situation to 8 pounds for pulling the bed down and 10 pounds for pulling the bed up from the operative to the vertical position.

SUMMARY OF THE INVENTION

The invention provides a spring counter-balanced folding wall bed having a supporting frame which is mounted in a fixed position either recessed in a wall or adjacent to a wall which includes a pair of laterally spaced apart fixed frame members supporting fixed bed pivot means. The fixed bed pivots are mounted substantially at floor level. A bed frame including a mattress support has its head end pivotally mounted on the bed pivot for pivotal movement with respect to the fixed frame member about a horizontal axis so that the bed is able to move between a horizontal operative position and a generally upright storage position. At least one compression spring is mounted on the bed frame. The axis of the spring is aligned with the bed frame, both of which extend horizontally when the bed is in its operative position. A spring compression pivot member is mounted in a fixed position relative to the fixed frame member and is displaced horizontally a predetermined distance D on the opposite side of the bed pivot from the bed frame. A spring compression member is connected pivotally at one end to the spring pivot and at the other end to one end of the spring to compress the spring progressively as the bed is lowered to the horizontal operative position. It is also preferred that the spring pivot be mounted upwardly from the bed pivot by a vertical distance H to provide additional spring compression as the bed is lowered.

In this way the compression of the spring will enable the bed to be easily raised and lowered with a force of only a few pounds.

These and other more detailed and specific objects of the invention will be apparent in view of the following specification and claims which illustrate the invention by way of example and indicate but a few of the various ways the objectives of the invention can be accomplished within the scope of the appended claims.

THE FIGURES

DETAILED DESCRIPTION OF THE INVENTION

Figure 1:
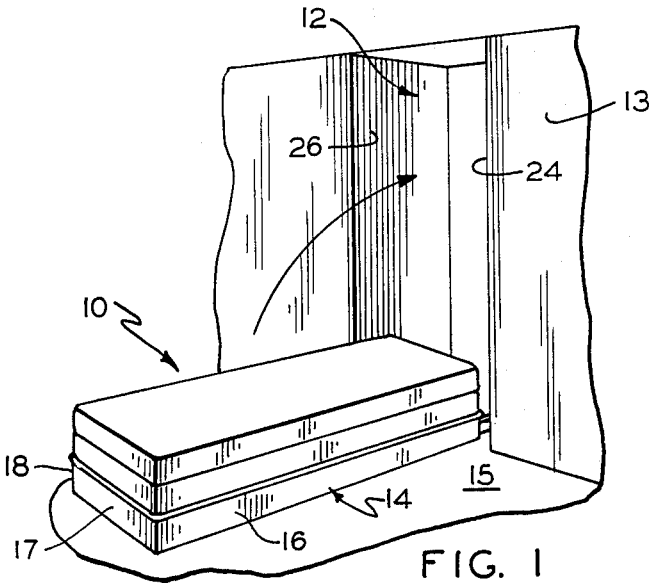
FIG. 1 is a perspective view of a bed counterbalanced in accordance with the invention in a horizontal operative position.
Figure 2:
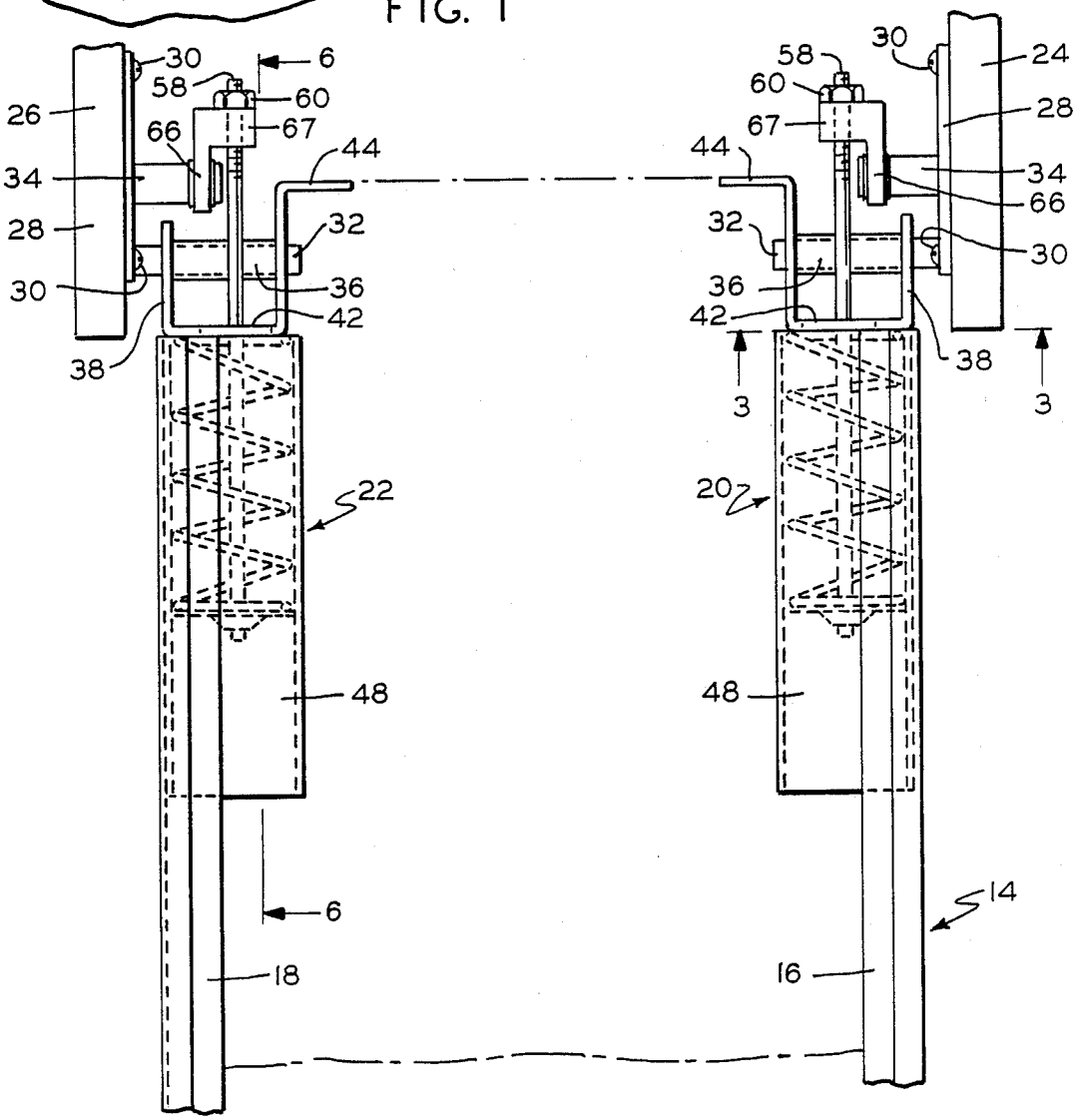
FIG. 2 is a plan view of the operating mechanism of the bed of FIG. 1 seen from above with the bed lowered.
Figure 5:
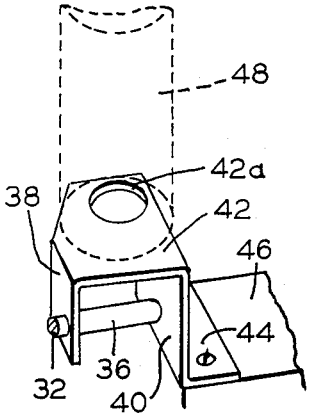
FIG. 5 is a view of the left hand spring mounting yoke as it appears when the bed is upright.
Figure 4:
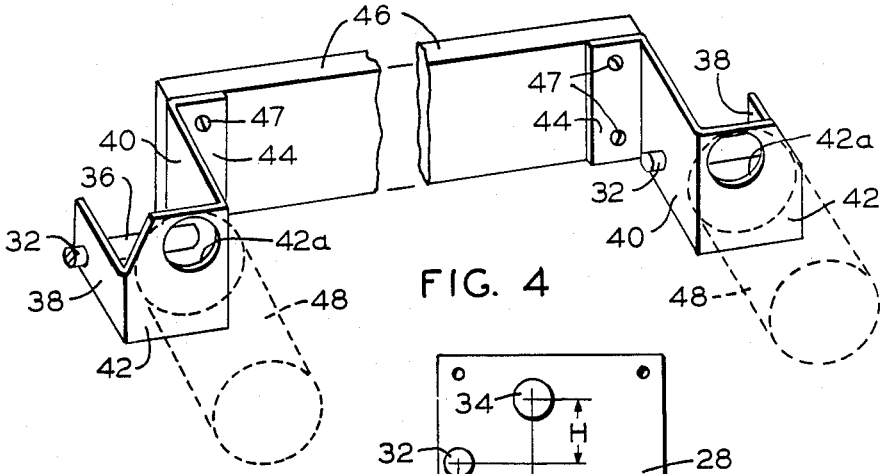
FIG. 4 is a partial perspective view of the counterbalancing mechanism in accordance with the invention with the springs and spring pivots removed for clarity of illustration.

As shown in FIG. 1 there is provided a spring counter-balanced folding wall bed 10 having a wall recess 12 into which the bed folds when raised from the operative horizontal position shown to a vertical position within a wall 13. It should be understood that the bed can be placed adjacent to a wall and need not be recessed within the wall as shown. The bed 10 includes a bed frame 14 having longitudinally extending normally horizontally disposed parallel bed frame members 16 and 18 of either wood or metal connected together at the foot end of the bed 10 by means of a cross piece 17. The bed frame 14 includes a bedding support comprising an innerspring 19 and mattress of suitable known construction. Secured to the bed frame members 16 and 18 are compression spring modules 20 and 22 for counterbalancing the bed 10 as it is raised and lowered. Placed in fixed positions on either side of the head of the bed are a pair of upright laterally spaced apart fixed frame members 24 and 26 which in the embodiment shown in FIG. 1 comprise the side walls of the recess 12. The upright members 24 and 26 normally comprise wooden boards. Secured to the uprights 24 and 26 are fixed mounting plates which serve as laterally spaced apart fixed frame members held in place by means of screws 30. As seen best in FIGS. 2 and 6 the mounting plates 28, which on left and right sides are mirror images of one another, are provided with a bed pivot 32 and a spring pivot 34. Pivots 32 and 34 in this case comprise steel pins each welded at its base to the plate 28. Pivotally mounted on the bed pivot 32 is a sleeve 36 adapted to pivot on the pin 32. Sleeve 36 is welded between the legs 38 and 40 of a generally U-shaped yoke 37 comprising parallel side legs 38 and 40, an intermediate connecting leg 42 and a centrally extending flange 44 at the free end of the leg 40.

Figure 6A:
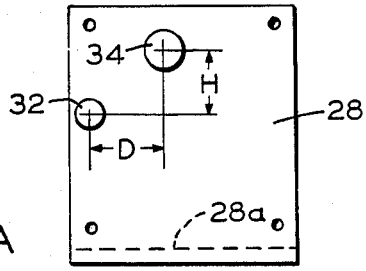
FIG. 6A is an elevational view of the pivots and their supporting plate with associated structure removed.

As shown in FIG. 6A, an optional floor plate 28a can be made integral with plate 28 for securing plate 28 to the floor.

Each of the bed frame members 16 and 18 has a spring housing 48 in the form of a metal tube or sleeve welded to it adjacent the yoke 37. The head ends of the frame members 16 and 18 and the housings 48 are both welded to the closed end of each yoke 37. In this way, when the foot of the bed is raised the frame members 16 and 18 as well as the spring housings 48 pivot as a unit with the yokes 37 about the spring pivots 32. When the bed is assembled the yokes 37 are connected to each other by means of a headboard 46 which is fastened to the flanges 44 of each of the yokes 37 by means of screws 47.

Figure 3:
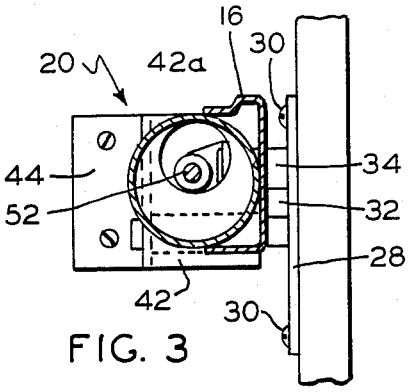
FIG. 3 is a vertical cross-sectional view taken on line 3—3 of FIG. 2.
Figure 7:
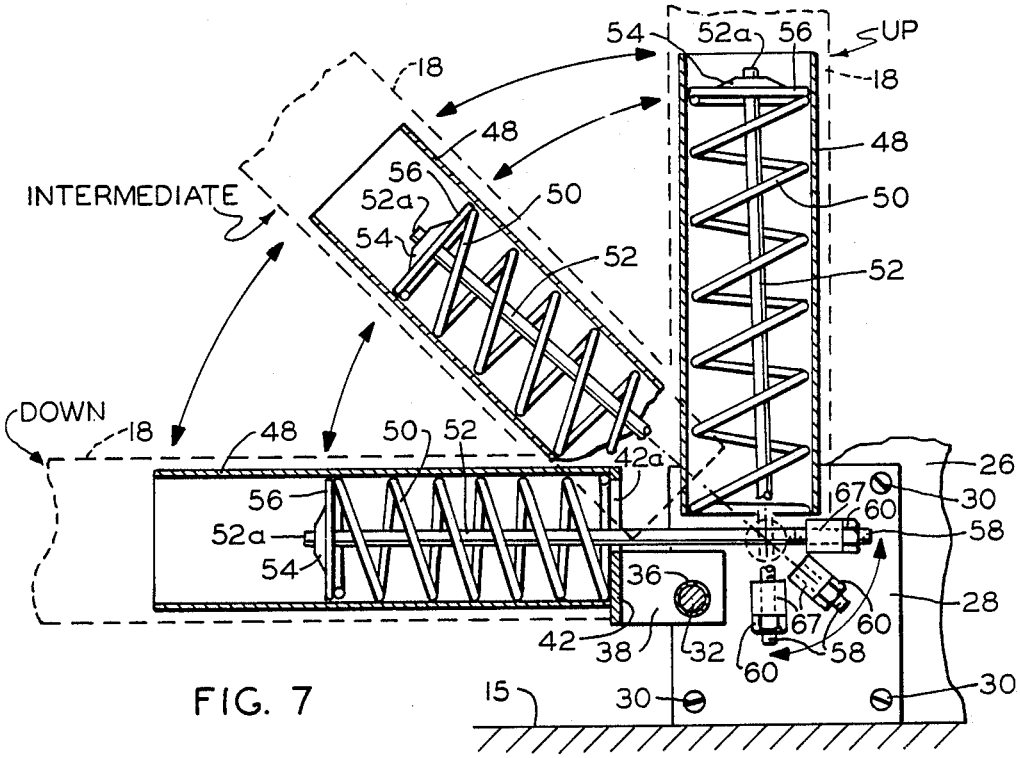
FIG. 7 is a view similar to FIG. 6 showing the mechanism and associated bed frame member in the raised, intermediate and down position.
Figure 6:
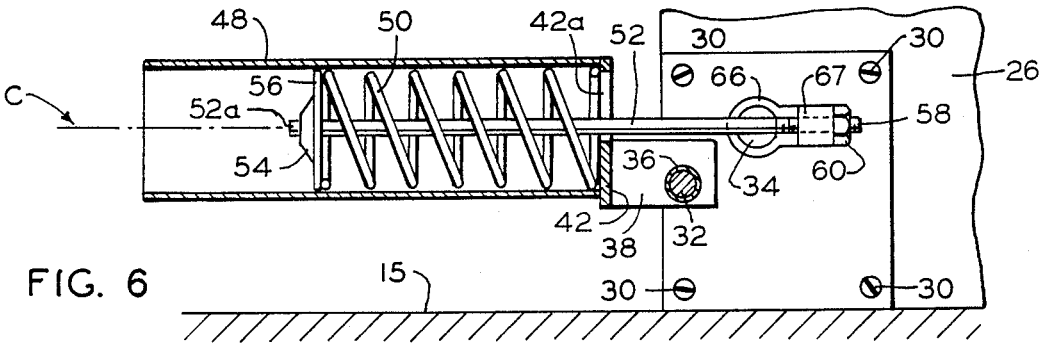
FIG. 6 is an elevational view partly in section taken on line 6—6 of FIG. 2.

Mounted within each of the housings 48 are compression springs 50 and each compression spring 50 is connected via a compression spring rod 52 to a spring pivot 34. The compression spring rod 52 has a fixed end 52a at the left end as seen in FIGS. 6 and 7 which is secured rigidly by means of a fastener 54 and mounting plate 56 to the left end of the compression spring 50. The opposite end of the rod 52 is threaded at 58 and is provided with a spring tension adjustment nut 60 which rests against a bracket plate 67 having a flange 66 that is bored and pivotally mounted upon the spring pivot 34. It can be held on the fixed pivot pin 34 by means of snap rings. In this way by tightening or loosening the nut 60 the spring compression rod 52 can be shortened or lengthened as required to compress or extend the spring 50 to suit the conditions for use so that when a heavier bed is to be used the nut 60 is tightened by shortening the rod 52 to accommodate the greater weight. It can be seen in FIG. 6 that the spring pivot 34 is positioned on the opposite side of the bed pivot 32 by a fixed pre-established distance D and it is this displacement which is in part responsible for the compression of the spring 50 as the bed is lowered. While not absolutely essential for operation it is also preferred that the pivot 34 be elevated a pre-determined distance H above the bed pivot 32 to provide additional compression of the spring 50 as the bed is lowered. It was also found that by placing the centerline C of the spring 50 above the bed pivot 32 by a short distance substantially equal to the distance H, important advantages could be realized. First, the spring pivot 34 could be raised a distance H above the bed pivot 32 to provide additional compression of the spring 50. Second, the rod 52 will remain in alignment or substantially in alignment with the rest of the mechanism including the spring housing 48 throughout operation. To accommodate the connecting rod 52 an opening 42a is provided in the connecting leg 42 of the yoke 37 (FIG. 3).

The mechanism is highly effective in operation, requires few parts and is rugged in construction. It also enables the bed to be raised and lowered easily within the parameters described above and can be easily adapted to fit a variety of bed sizes. Moreover, the counter-balancing mechanism is unitized, compact and is sufficiently integrated to be considered a module which can be adapted for and placed upon a variety of beds of various designs. This makes it more universally adaptable. It should be noted that there are no levers or extensions which project out from it that may make it difficult to use or adapt for various applications.

In a typical application, to lower the bed 5.7° required a downward force of 0.39 pounds; to lower the bed 22° required a downward force of 0.89 pounds; to lower the bed 45.6° required a downward force of 5 pounds; to lower the bed 68.4° required a downward force of 7.28 pounds; to lower the bed 79.8° required a downward force of 5.4 pounds and to lower the bed 85.5° required a downward force of 3.11 pounds. While the dimensions of the device can obviously be changed to suit various circumstances, in a typical situation H can be $1\frac{5}{8}$ inches and D can be 2 inches.

The term "connecting rod" is used herein in broad terms to refer generally to any force transmitting member and will encompass other articles such as tubing, chain, cable, straps, ropes or the like.

Many variations of the present invention within the scope of the appended claims will be apparent to those skilled in the art once the principles described above are understood.

What is claimed is:

1. A spring counterbalanced folding wall bed comprising a supporting frame structure including a pair of laterally spaced apart fixed frame members supporting fixed bed pivot means at substantially floor level, a bed frame including a mattress supporting means, said bed frame having a head end pivotally mounted on the bed pivot means for pivotal movement with respect to the fixed frame members about a horizontal axis between a horizontal operative position and a generally upright storage position, compression spring means mounted upon the bed frame and having a spring axis in alignment with the bed frame, a spring pivot member mounted in a fixed position relative to the fixed frame member and displaced horizontally a predetermined distance D on the opposite side of the bed pivot from the bed frame, a spring compression rod having one end pivotally connected to the spring pivot and the other end connected to one end of the spring to compress the spring progressively as the bed is lowered to the operative position, the laterally spaced apart fixed frame members comprise a pair of laterally spaced apart frame elements, each of said frame elements has a pair of pivots mounted thereon including said bed pivot mounted at a first elevation and said spring pivot mounted at a higher elevation spaced vertically from the bed pivot by a predetermined height H whereby the compression spring is compressed through the action of the connecting rod when moved through an angle of 90° by an overall distance which is approximately equal to the sum of D plus H.

2. The apparatus of claim 1 wherein said bracket comprises an L-shaped member having a bracket plate extending perpendicular to the connecting rod and having a bored opening therethrough to accommodate said connecting and said bracket includes a flange extending parallel to the connecting rod and being pivotally mounted upon the spring pivot whereby the bracket plate is displaced from the axis of the spring pivot.

3. The apparatus of claim 2 wherein the displacement of the bracket plate from the spring pivot is on the opposite side of the spring pivot from the bed frame whereby the connecting rod extends from the spring beyond the spring pivot and projects through said bracket plate on the opposite side thereof from the bed frame and an adjustment means comprising a nut threaded on the connecting rod on the opposite side of the bracket plate from the bed frame.

4. A spring counterbalanced folding wall bed comprising a supporting frame structure including a pair of laterally spaced apart fixed frame members supporting fixed bed pivot means at substantially floor level, a bed frame including a mattress supporting means, said bed frame having a head end pivotally mounted on the bed pivot means for pivotal movement with respect to the fixed frame members about a horizontal axis between a horizontal operative position and a generally upright storage position, compression spring means mounted upon the bed frame and having a spring axis in alignment with the bed frame, a spring pivot member mounted in a fixed position relative to the fixed frame member and displaced horizontally a predetermined distance D on the opposite side of the bed pivot from the bed frame, a spring compression rod having one end pivotally connected to the spring pivot and the other end connected to one end of the spring to compress the spring progressively as the bed is lowered to the operative position, a bracket member is pivotally secured on the spring pivot, said bracket includes a bracket plate, said connecting rod extends through the bracket plate and an adjustable retainer means is operatively associated with the bracket plate of the connecting rod for extending or retracting the connecting rod to thereby release or compress said spring and thereby adjust said spring to appropriately counterbalance the weight of the bed.

5. A spring counterbalanced folding wall bed comprising a supporting frame structure including a pair of laterally spaced apart fixed frame members supporting fixed bed pivot means at substantially floor level, a bed frame including a mattress supporting means, said bed frame having a head end pivotally mounted on the bed pivot means for pivotal movement with respect to the fixed frame members about a horizontal axis between a horizontal operative position and a generally upright storage position, compression spring means mounted upon the bed frame and having a spring axis in alignment with the bed frame, a spring pivot member mounted in a fixed position relative to the fixed frame member and displaced horizontally a predetermined distance D on the opposite side of the bed pivot from the bed frame, a spring compression rod having one end pivotally connected to the spring pivot and the other end connected to one end of the spring to compress the spring progressively as the bed is lowered to the operative position, said spring is a helical compression spring, said spring is mounted to fit within a tubular housing, said tubular housing is affixed to an inside surface of said bed frame.

6. The apparatus of claim 5 wherein a yoke is affixed to the end of said tubular housing adjacent the spring pivot and said yoke includes a pair of parallel legs pivotally mounted upon the bed pivot and a cross-member is connected between one such yoke and a similar yoke on the opposite side of the bed frame.

* * * * *